US006270278B1

(12) United States Patent
Mauro

(10) Patent No.: US 6,270,278 B1
(45) Date of Patent: Aug. 7, 2001

(54) SPRAY NOZZLE ATTACHMENT WITH INTERCHANGEABLE HEADS

(76) Inventor: Ralph M. Mauro, 3621 SW. 13th, Des Moines, IA (US) 50315

( * ) Notice: Subject to any disclaimer, the term of this patent is extended or adjusted under 35 U.S.C. 154(b) by 0 days.

(21) Appl. No.: 09/340,840

(22) Filed: Jun. 28, 1999

Related U.S. Application Data

(63) Continuation of application No. 09/018,113, filed on Feb. 3, 1998, now abandoned.

(51) Int. Cl.[7] ..... A46B 11/06
(52) U.S. Cl. ..... 401/289; 401/290; 401/282
(58) Field of Search ..... 401/289, 6, 290, 401/282, 268, 270

(56) References Cited

U.S. PATENT DOCUMENTS

| | | | |
|---|---|---|---|
| D. 178,999 | 10/1956 | Graff | D91/3 |
| D. 179,257 | 11/1956 | Moore | D91/3 |
| D. 179,386 | 12/1956 | Graff | D91/3 |
| D. 317,988 | 7/1991 | Nicholson | D4/115 |
| D. 326,019 | 5/1992 | Spangler | D4/118 |
| 588,047 | 8/1897 | Arbuckle . | |
| 1,184,662 | 5/1916 | Semple . | |
| 1,235,466 | 7/1917 | Harrison . | |
| 1,298,787 | 4/1919 | Reid . | |
| 1,617,569 | 2/1927 | Boyle . | |
| 1,901,812 | 3/1933 | Huey . | |
| 2,265,804 * | 12/1941 | Deady | 15/129 |
| 2,266,902 | 12/1941 | Perkins | 299/84 |
| 2,652,850 | 9/1953 | Manville | 137/218 |
| 2,748,411 | 6/1956 | O'Brien | 15/129 |
| 2,807,816 | 10/1957 | O'Brien | 15/129 |
| 3,101,506 | 8/1963 | Himes . | |
| 4,761,839 | 8/1988 | Ganaway | 4/654 |
| 4,812,070 | 3/1989 | Marty | 401/289 |
| 5,169,252 | 12/1992 | Chappell . | |
| 5,316,401 | 5/1994 | Sears | 401/139 |

* cited by examiner

*Primary Examiner*—David J. Walczak
(74) *Attorney, Agent, or Firm*—Zarley, McKee, Thomte, Voorhees & Sease

(57) ABSTRACT

A spray nozzle attachment with a hollow tubular body for mounting on the spray nozzle and interchangeable cleaning heads for removable mounting on the body. The heads may include different cleaning tools, such as a brush, a scouring pad, or a bottle cleaner. The body of the attachment is frictionally fit upon the spray nozzle, and the cleaning head is frictionally fit onto the body. The body of the attachment includes a central bore such that water may be directed from the nozzle onto objects to be cleaned.

19 Claims, 4 Drawing Sheets

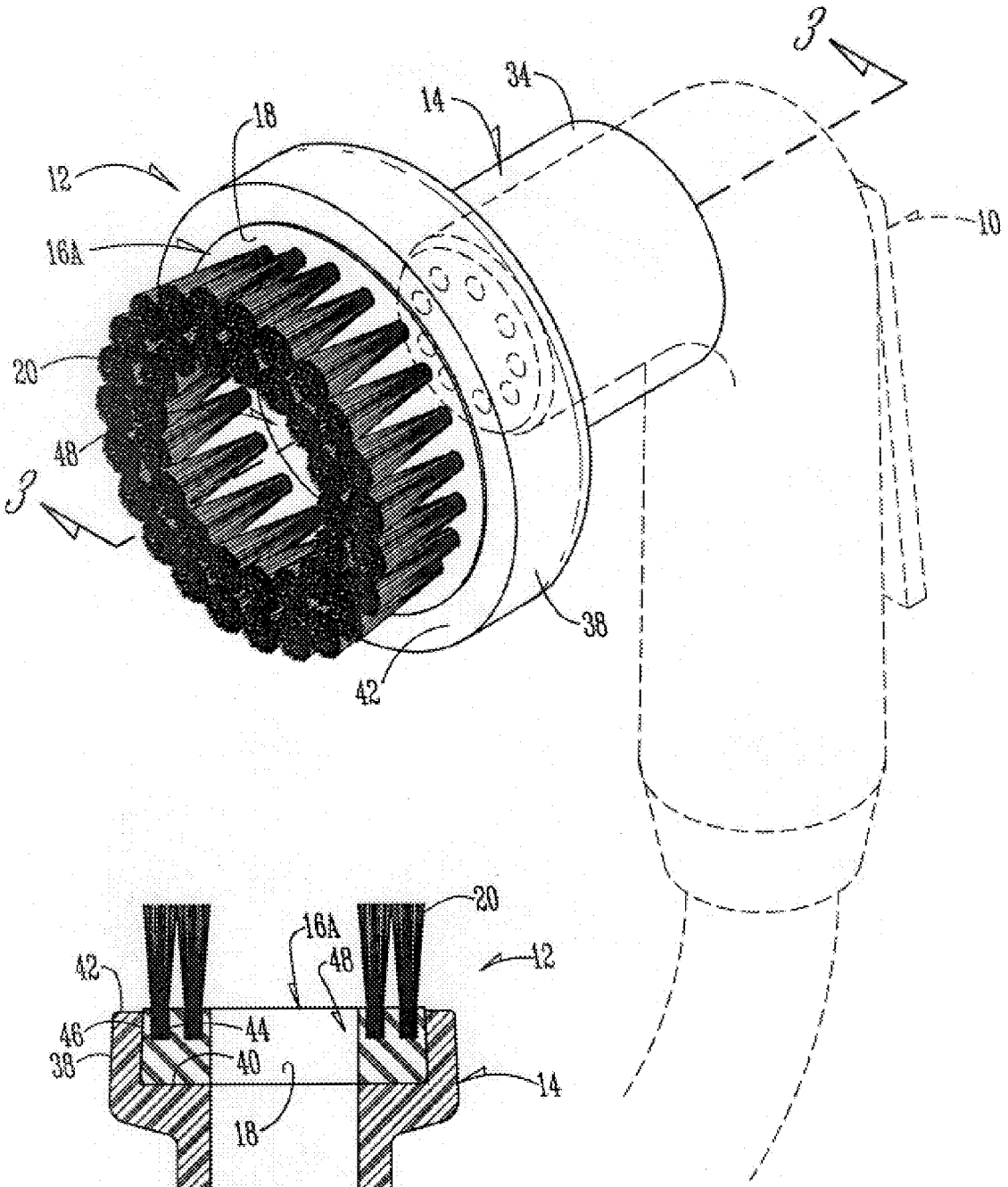
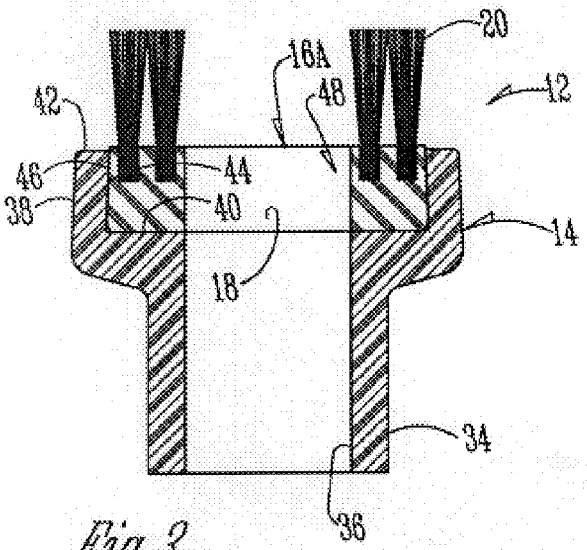
Fig. 3
Fig. 1

SPRAY NOZZLE ATTACHMENT WITH INTERCHANGEABLE HEADS

This is a continuation of U.S. Ser. No. 09/018,113 filed on Feb. 3, 1998 now abandoned.

BACKGROUND OF THE INVENTION

Prior art attachments for spray nozzles, such as those commonly found on kitchen sinks, typically include a single cleaning head with bristles for facilitating the cleaning of dishes and the like. These prior art attachments have complex structures to secure the attachment to the spray nozzle, and often include O-ring seals to prevent water leakage between the spray nozzle and the attachment. Such construction for prior art nozzle attachments necessarily adds to the cost of the product, and increases the time required to install the attachment on the spray nozzle. Also, these prior art spray nozzle attachments do not include interchangeable cleaning heads, such as brush bristles, scouring pads, and bottle cleaners.

Accordingly a primary objective of the present invention is the provision of an improved spray nozzle attachment having interchangeable cleaning heads.

Another objective of the present invention is the provision of an improved spray nozzle attachment having a simple and inexpensive construction.

A further objective of the present invention is the provision of an improved spray nozzle attachment which can be quickly and easily mounted on the spray nozzle by a user.

Another objective of the present invention is the provision of an attachment for a kitchen sink spray nozzle which allows water from the nozzle to be directed onto an object to be cleaned without obstruction by the attachment.

Still another objective of the present invention is the provision of a spray nozzle attachment which is economical to manufacture and durable in use.

These and other objectives will become apparent from the following description of the invention.

SUMMARY OF THE INVENTION

The attachment of the present invention for use on a spray nozzle includes a hollow tubular body mountable on the spray nozzle. One of a plurality of interchangeable cleaning heads is selectively and removably mounted on the body. The cleaning tools includes an annular base and a cleaning tool extending from the base. The base of the cleaning head seats upon a shoulder on the body, with an annular surface on the body frictionally engaging an annular surface on the base so as to retain the cleaning head on the body. The cleaning tool is different on each cleaning head, with the various cleaning heads including a brush, a scouring pad, a scrubber, and a bottle cleaner. A passageway extends through the body and the cleaning head such that water from the nozzle can be directed onto the dishes or other objects to be cleaned.

BRIEF DESCRIPTION OF THE DRAWINGS

FIG. 1 is a perspective view of a brush attachment according to the present invention mounted upon a kitchen sink spray nozzle.

FIG. 3 is a sectional view of the brush attachment taken along lines 3—3 of FIG. 1.

DETAILED DESCRIPTION OF THE INVENTION

Figure 2:
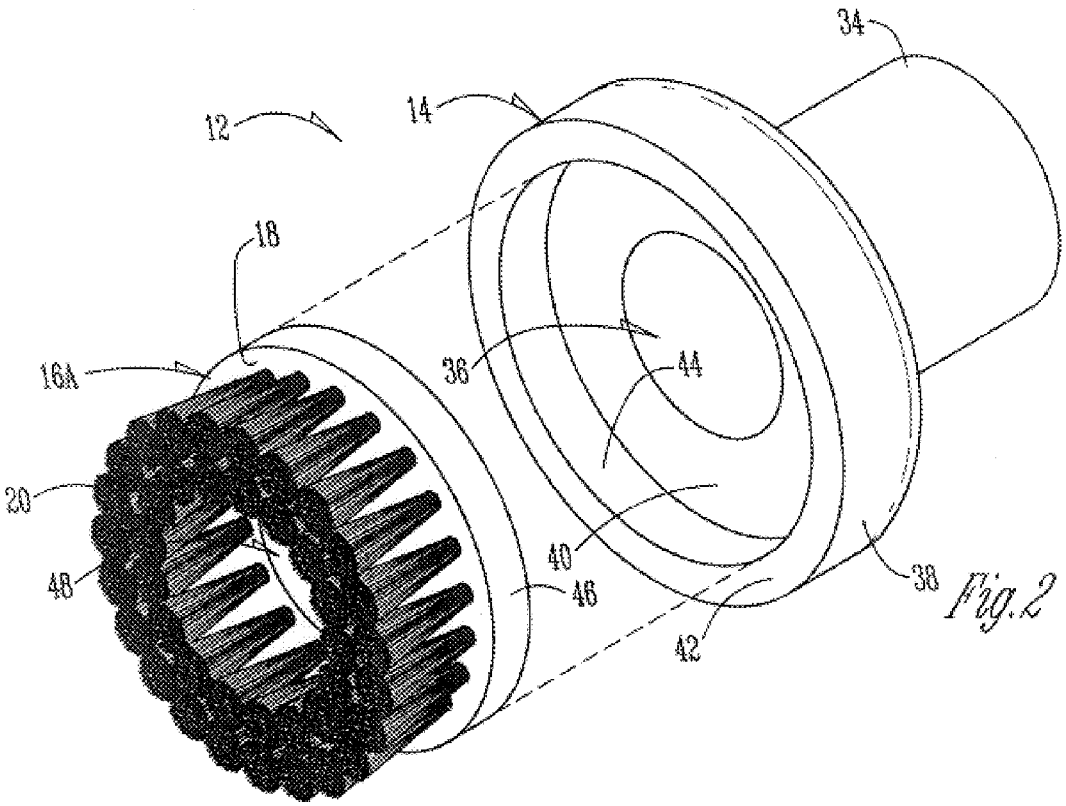
FIG. 2 is an exploded perspective view of the brush attachment of the present invention.

In the drawings, a spray nozzle, such as commonly found on kitchen sinks is generally designated by the reference numeral 10. The construction of the spray nozzle 10 is conventional and does not constitute a part of the present invention. It is also understood that the present invention may be used with other spray nozzles, such as those found on garden hoses and the like.

The present invention is directed towards a spray nozzle attachment 12 which can be quickly and easily mounted upon the spray nozzle 10 for cleaning of miscellaneous objects, such as plates, dishes, bowls and other kitchen cooking and eating pieces. The attachment 12 generally includes a hollow tubular body 14 and a cleaning head 16A–16C.

Figure 4:
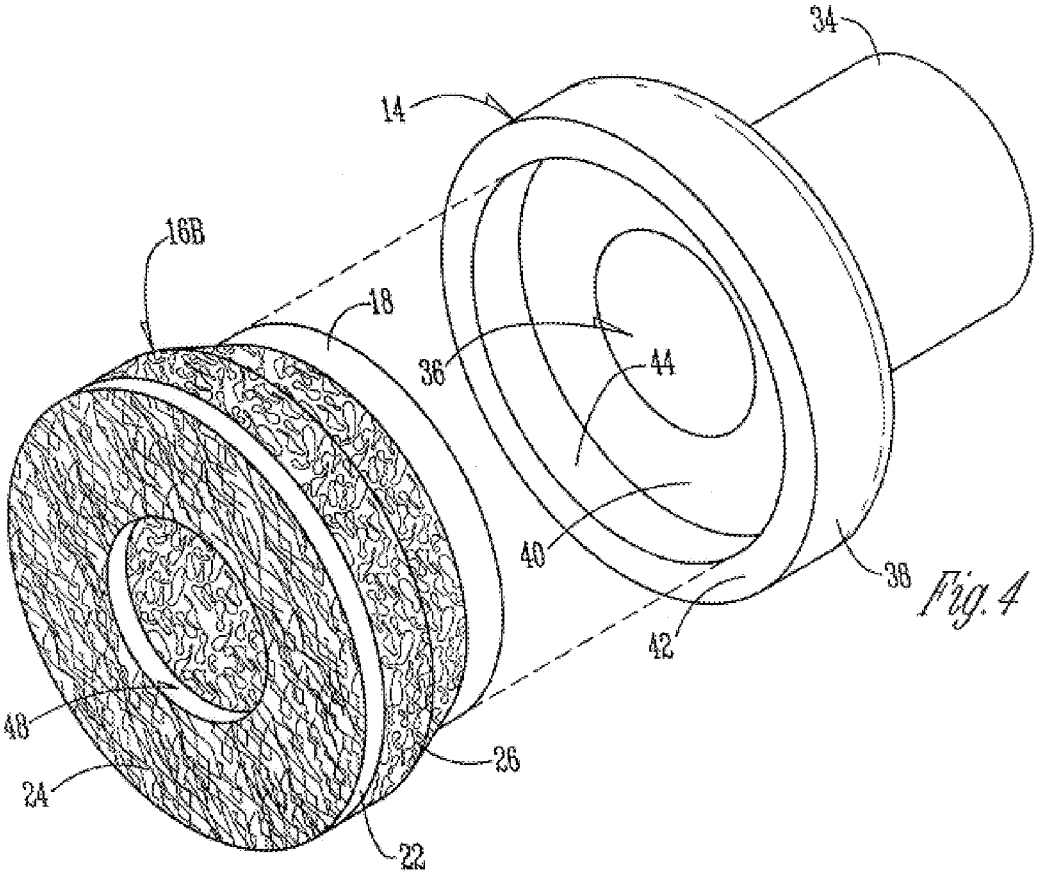
FIG. 4 is an exploded perspective view of a scouring pad attachment according to the present invention.
Figure 5:
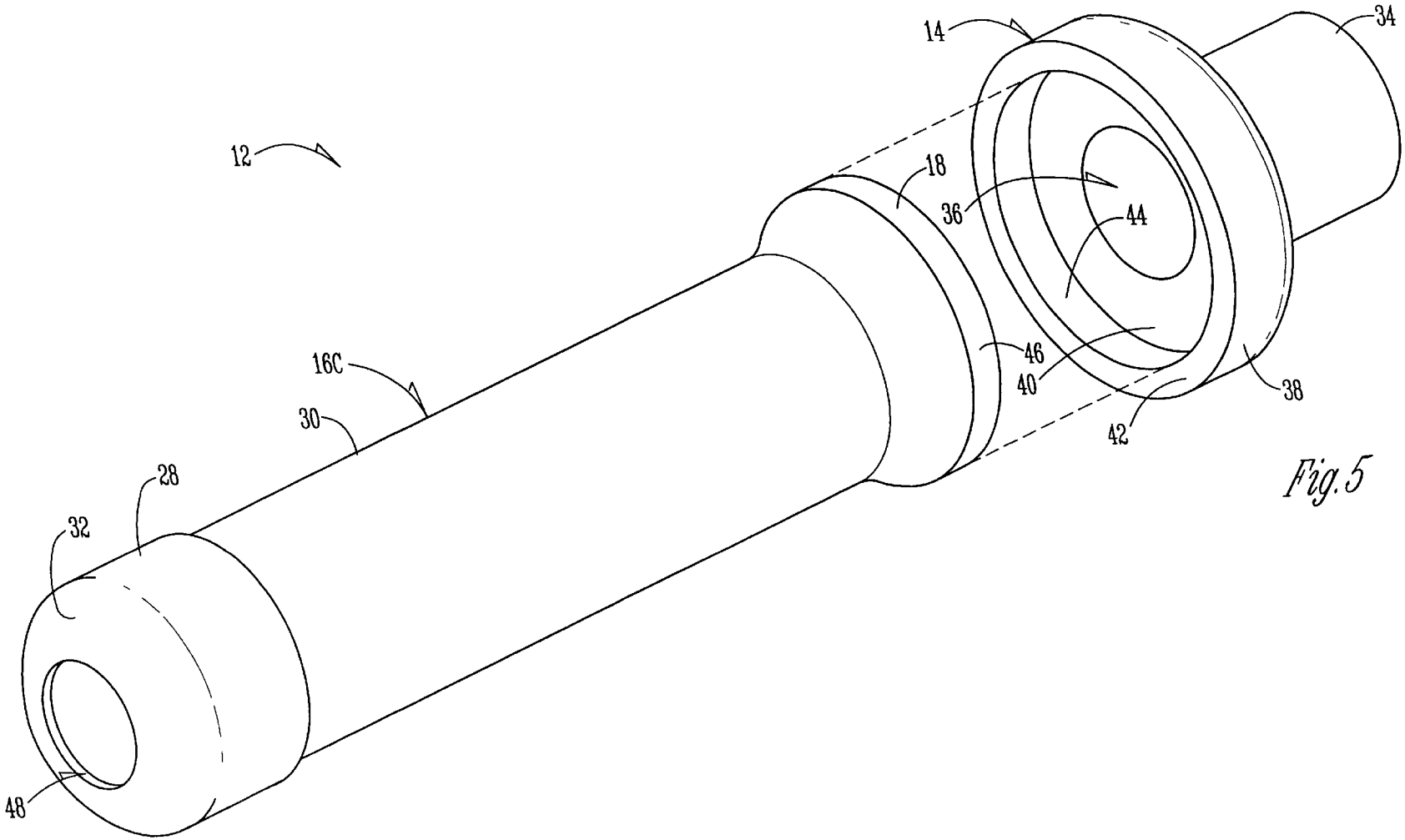
FIG. 5 is an exploded perspective view of a bottle cleaner attachment according to the present invention.

Multiple cleaning heads, such as heads 16A, 16B and 16C shown in FIGS. 1–5, can be interchanged with one another upon the body 14. Each cleaning head 16A–C includes a base 18 and a cleaning tool, with the tool being different on each cleaning head 16A–C. For example, in FIGS. 1–3, the tool is shown to be a brush 20. In FIG. 4, the tool is shown to be scouring pad 22 having a coarse scrubbing surface 24 mounted upon a resilient foam 26 on the base 18. FIG. 5 shows a bottle cleaning tool 28 which is elongated so as to reach the bottom of bottles, such as a baby bottle. The elongated body 30 of the bottle cleaner 28 may be constructed of a foam material, with the end 32 of the bottle cleaner 28 being coarser for scrubbing the bottom of the bottles. It is contemplated that other cleaning tools may be formed on the base 18 of the cleaning head 16, without departing from the scope of the present invention. The tool is secured to the base 18 in any convenient manner, such as with water resistant adhesive.

The various cleaning heads 16A, 16B and 16C are quickly and easily interchangeable with one another. More particularly, each cleaning head 16A–C is frictionally fit upon the body 14, without the use of fasteners or seals. In the preferred embodiment of the body 14 shown in FIGS. 1–5, the body includes a rearward end 34 with a bore 36 extending therethrough. The diameter of the bore 36 is sufficient to co-operate with the outer diameter of the nozzle 10, such that the body 14 is frictionally fit upon the nozzle. Preferable, the body has a one-piece construction and is made of a rubber material to assure a secure frictional fit on the nozzle 10, without the need to use other fastening or securement devices.

The forward end 34 of the body 14 includes a shoulder 40 extending radially outwardly from the bore 36 and terminating in a forwardly extending lip 42 which defines an inner annular surface 44. The annular base 18 of each cleaning head 16A–C includes an outer annular surface 46 which is matingly and frictionally received within the annular surface 44 of the body 14 such that the cleaning head is retained on the body. The base 18 also includes a central opening 48 which aligns with the bore 36 of the body 14 such that water from the spray nozzle 10 can be directed upon the objects to be cleaned.

Figure 6:
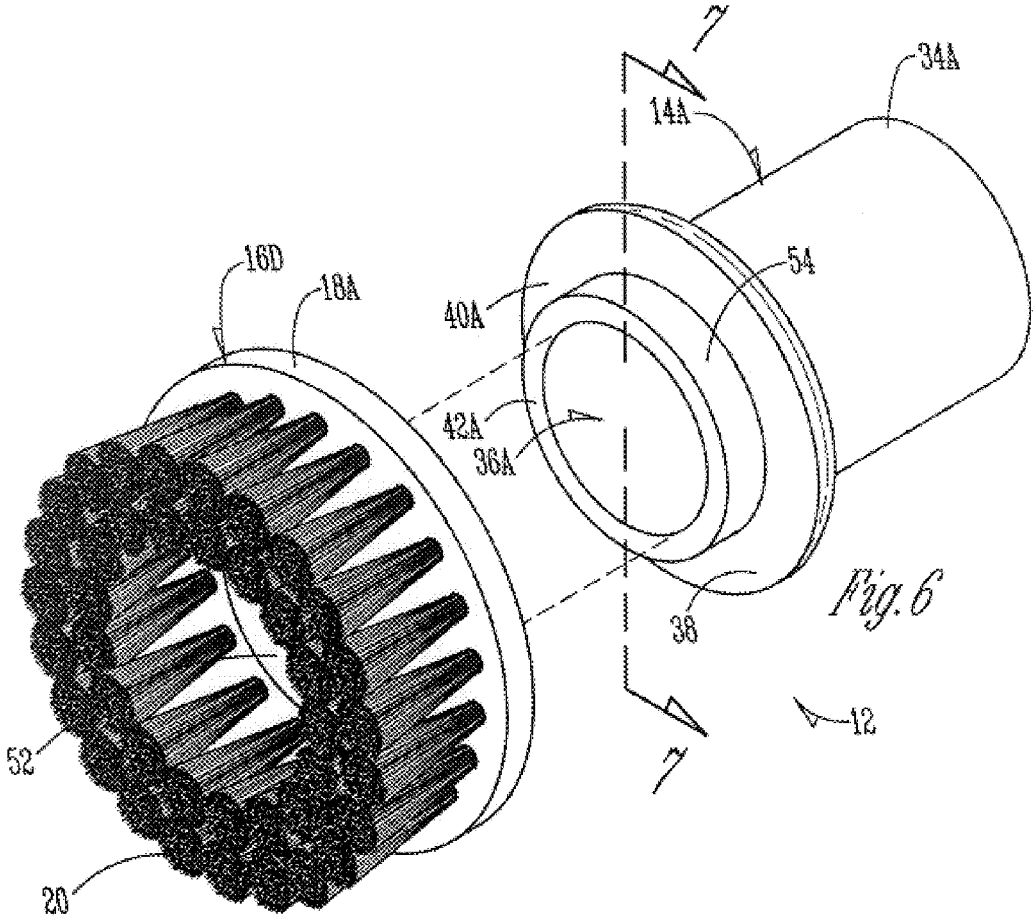
FIG. 6 is a perspective view of an alternative embodiment of the brush attachment of the present invention.
Figure 7:
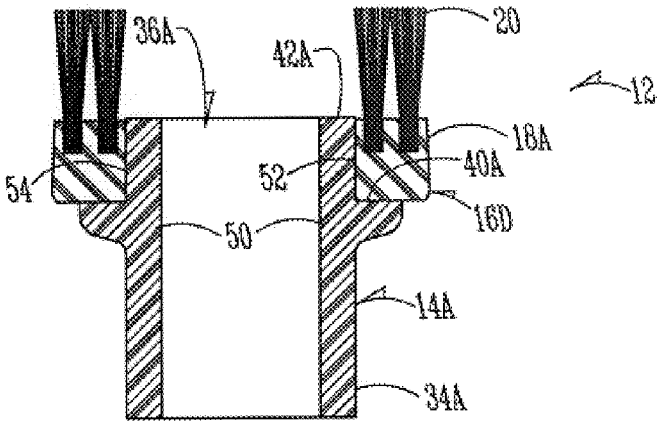
FIG. 7 is a sectional view taken along lines 7—7 of FIG. 6.

In an alternative embodiment shown in FIGS. 6 and 7, the body 14A includes a shoulder 40A which extends radially outward from the wall 50 of the bore 36A and terminating in a forwardly extending lip 42A. The forward end 34A of the wall 50 includes an outer annular surface 52 which matingly and frictionally receives the inner annular surface 54 surrounding the central opening 48 of the base 18A. Thus, in the preferred embodiment, the cleaning head 16A–C fits within the forward end 38 of the body 14, wherein as in the alternative embodiment shown in FIGS. 6 and 7, the cleaning head 16D fits around the forward end 38A of the body 14A.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. An attachment kit for a kitchen sink spray nozzle, comprising:

a body adapted to mount on the spray nozzle, the body being attached solely by a frictional fit on the hose spray nozzle and having an outer annual surface; and a plurality of interchangeable cleaning heads each having an inner annular surface removably frictionally fit to the outer annular surface on the body so as to retain each cleaning head on the body.

2. The attachment kit of claim 1 wherein the body has an internal bore and each cleaning head has a central opening, such that water from the spray nozzle passes through the bore of the body and the opening of the cleaning head.

3. The attachment kit of claim 1 wherein each cleaning head includes a base for mating mounting on the body and a cleaning tool, the tool being different for each of the plurality of cleaning heads.

4. The attachment kit of claim 3 wherein the tool is a brush.

5. The attachment kit of claim 3 wherein the tool is a scouring pad.

6. The attachment kit of claim 3 wherein the tool is a bottle cleaner.

7. An attachment for a kitchen sink nozzle on a hose, comprising:

a body with a bore therethrough adapted to mount onto the spray nozzle soley by a frictional fit and having an inner annular surface;

a plurality of cleaning heads each being selectively frictionally mountable on the body, each cleaning head including a base with an outer annular surface and an opening through which water from the spray nozzle can pass and a cleaning tool extending from the base for facilitating the cleaning of objects;

a shoulder on the body upon which the cleaning heads are seated; and the inner annular surface on the body matingly engaging the outer annular surface on each cleaning head so as to retain each cleaning head on the body.

8. The attachment of claim 7 wherein the body has a rear end with an inner diameter corresponding to the spray nozzle and an enlarged forward end to matingly receive the one of the cleaning heads.

9. The attachment of claim 7 wherein the cleaning tools each includes an opening aligned with the opening of the base through which water from the spray nozzle can pass.

10. The attachment of claim 7 wherein the tool is a brush.

11. The attachment of claim 7 wherein the tool is a scrubber.

12. The attachment of claim 7 wherein the tool is a scouring pad.

13. The attachment of claim 7 wherein the tool is elongated for cleaning bottles.

14. The attachment of claim 13 wherein the tool includes an elongated portion which extends approximately the length of a bottle outwardly from the spray nozzle.

15. The attachment of claim 14 wherein the elongated portion is made of foam.

16. The attachment of claim 14 wherein the tool includes a coarse end.

17. The attachment of claim 7 wherein the body is made from rubber.

18. The attachment of claim 7 wherein the body has a one-piece construction.

19. The attachment of claim 7 wherein the bore of the body and the opening in the base of the cleaning head provide an unobstructed path for the flow of water from the nozzle and through the attachment.

* * * * *